US006386839B1

(12) United States Patent
Chuang

(10) Patent No.: US 6,386,839 B1
(45) Date of Patent: May 14, 2002

(54) HIGH PERFORMANCE RADIATOR FAN

(76) Inventor: Wen-Hao Chuang, No. 150, Lane 250, Kung-Yeh 2nd Rd., Lin-Yuan Hsiang, Kaohsiung Hsien (TW)

( * ) Notice: Subject to any disclaimer, the term of this patent is extended or adjusted under 35 U.S.C. 154(b) by 0 days.

(21) Appl. No.: 09/749,701

(22) Filed: Dec. 28, 2000

(51) Int. Cl.[7] ..... F04B 17/00; F04B 35/00; F04B 23/14; F01D 1/02

(52) U.S. Cl. ..... 417/356; 417/355; 417/354; 417/201; 415/199.6

(58) Field of Search ..... 417/356, 354, 417/201, 355; 415/199.4, 199.6

(56) References Cited

U.S. PATENT DOCUMENTS 2,936,948 A * 5/1960 Eck ..... 415/199.4
3,794,443 A * 2/1974 McCarty ..... 416/175
3,867,062 A * 2/1975 Troller ..... 415/194
4,150,916 A * 4/1979 Tsutsui et al. ..... 415/143
4,167,369 A * 9/1979 Ishihara ..... 416/185
4,459,087 A * 7/1984 Barge ..... 417/356
4,553,075 A * 11/1985 Brown et al. ..... 318/254
5,895,206 A * 4/1999 Chuang et al. ..... 416/189

FOREIGN PATENT DOCUMENTS

JP 4-1314 * 1/1992 ..... E01H/5/09

* cited by examiner

*Primary Examiner*—Michael Koczo
*Assistant Examiner*—Timothy P. Solak
(74) *Attorney, Agent, or Firm*—Birch, Stewart, Kolasch & Birch, LLP

(57) ABSTRACT

A high performance radiator fan includes an axial fan and a centrifugal fan. The axial fan has a plurality of arched-shaped blades located between a protrusive circular hub and a closed motor shell for drawing airflow from the upper end of the axial fan through the curved blades into the centrifugal fan. The airflow is converged and spun out at high speed and great volume by centrifugal force to enhance heat dissipation efficiency.

1 Claim, 2 Drawing Sheets

HIGH PERFORMANCE RADIATOR FAN

BACKGROUND OF THE INVENTION

This invention relates to a high performance radiator fan and particularly a fan that uses a closed periphery motor shell and a protrusive circular hub in an axial fan to draw airflow completely and axially into a centrifugal fan located beneath for dischare by centrifugal force thereby generating maximum air flow power.

Conventional radiator fans mostly are designed based on a barrel body with a flat bottom end and have formed blades attached to the periphery of the barrel body. Because of molding design limitation, the blades usually do not align to the same axial line. There is a gap between two adjacent blades. Kinetically, because of the design limitation mentioned above, it is difficult for the blades to increase airflow discharge volume and will result in not very high heat dissipation coefficient. Their disadvantages may be summarized as follows:

1. The top end of a conventional blade is a flat plane. Airflow volume drawn from the upper end of the fan is limited when the blades are rotating. As a result, discharged airflow volume and speed are relatively small.
2. As the gap between every two blades is quite large, airflow cannot be converged effectively before discharging out. Rather, airflow tends to disperse and results in not adequate airflow discharge volume and poor heat dissipation efficiency.

SUMMARY OF THE INVENTION

In view of aforesaid disadvantages, it is therefore an object of this invention to provide a high performance radiator fan which may increase airflow output and enhance heat dissipation effect.

The radiator fan according to this invention includes two sections. The upper section has a protrusive circular hub attached to a plurality of equally spaced formed blades. The outer rim of the blades attaches to a closed motor shell. The lower section is a barrel structure having periphery equally divided by a plurality of vanes which have a portion corresponding to the blades located thereabove and have other portions formed a centrifugal fan. Combining the upper and lower section thus forms a high performance radiator fan of this invention.

In one aspect, the blades at the upper section are arch-shaped and extend outward from the circular hub to the closed motor shell so that they will generate suction force to completely draw airflow through the curved blades to the centrifugal fan which in turn converges the airflow for discharging out. As this invention has two sets of separate blades and vanes, they may be made by separate molds. The blades may couple with the vanes whose number is twice as many of the blades. The blades and vanes may be aligned to same axial line (the upper end of the vanes may be superposed with the lower end of the blades at the same axial line and be configured separately). Airflow drawn from the upper section will be converged in this area and be discharged by the rotating vanes. It thus may produce maximum airflow volume in a converged manner whereby to greatly enhance heat dissipation efficiency.

BRIEF DESCRIPTION OF THE DRAWINGS

The invention, as well as its many advantages, may be further understood by the following detailed description and drawings, in which.

DESCRIPTION OF THE PREFERRED EMBODIMENTS

Figure 2:
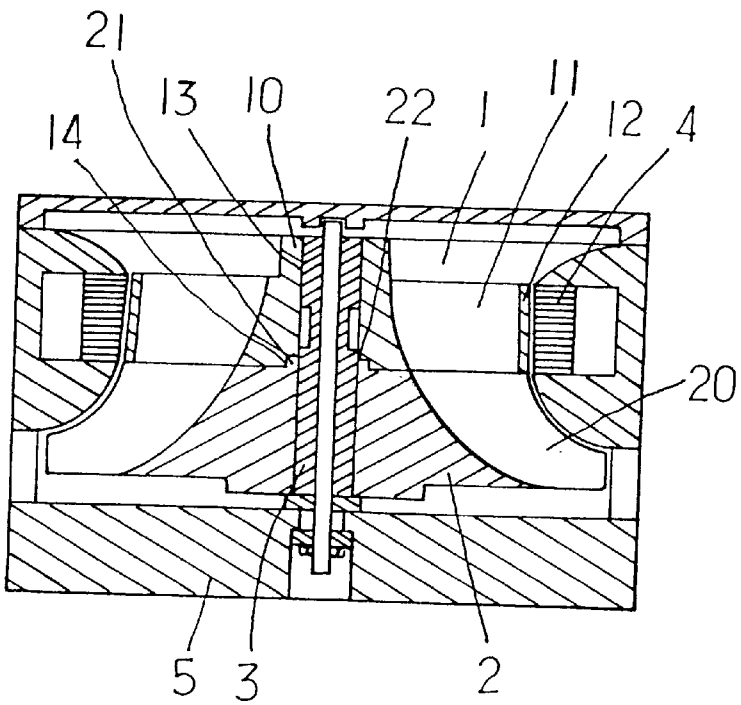
FIG. 2 is a sectional view of this invention.
Figure 1:
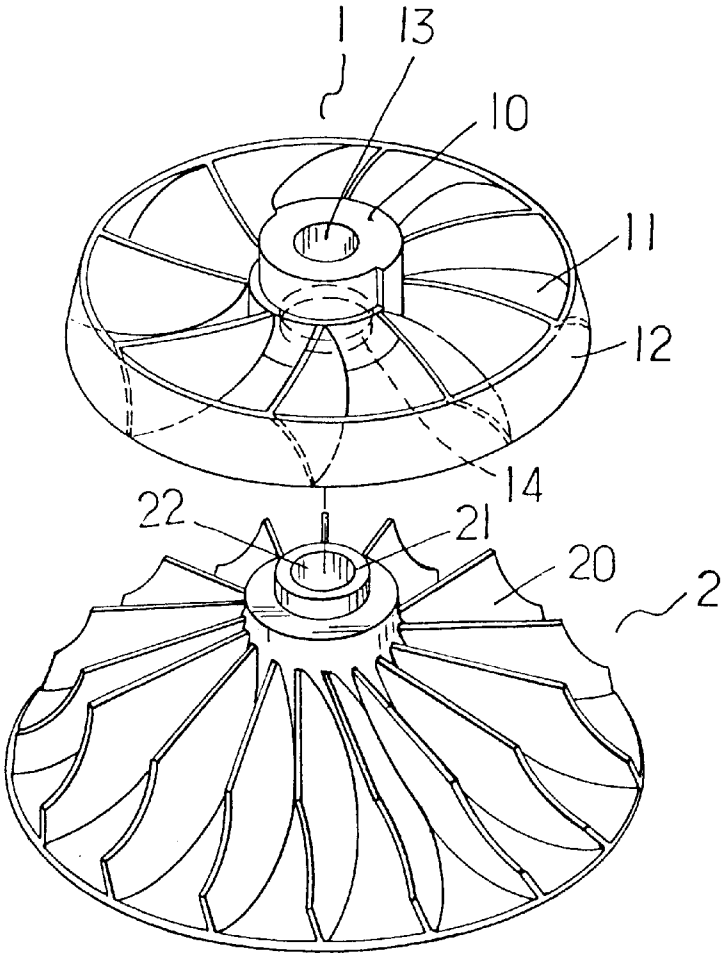
FIG. 1 is an exploded view of this invention.

Referring to FIGS. 1 and 2, this invention includes an axial fan 1 located at the upper section and a centrifugal fan 2 located at the lower section. The axial fan 1 has a protrusive circular hub 10 in the center. There are a plurality of equally spaced arch-shaped blades 11 which have respectively one end attached to the outside circumference of the hub 10 and another end thereof attached to a closed motor shell 12. The hub 10 has a spindle aperture 13 formed therein for engaging with a spindle 3 and a circular recess 14 formed at the bottom end thereof.

The centrifugal fan 2 has a barrel structure in the center which has an engaging ring 21 at the top end engageable with the recess 14 when assembly and a plurality of equally spaced vanes 20 attached to the circumference of the barrel structure and extended radially outward to the periphery thereof. The number of the vanes 20 is twice of the blades 11. Each blade 11 is axially mated and connected with one of the vanes 20. The barrel structure has a spindle opening 22 in the center for fastening to the spindle 3. The axial fan 1 and centrifugal fan 2 thus formed then may be assembled to become the radiator fan of this invention. Outside the periphery of the fan assembly, a coil 4 is provided around the motor shell 12. Then the fan assembly may be mounted on a radiator block 5 through the engagement of the spindle 3.

Figure 4:
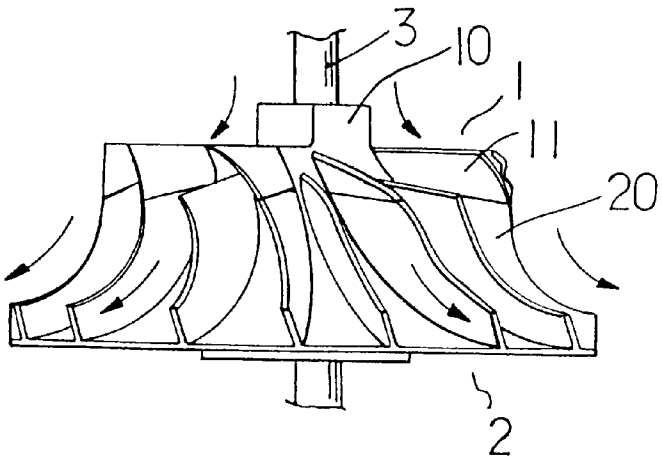
FIG. 4 is a fragmentary schematic view of this invention, showing airflow path.
Figure 3:
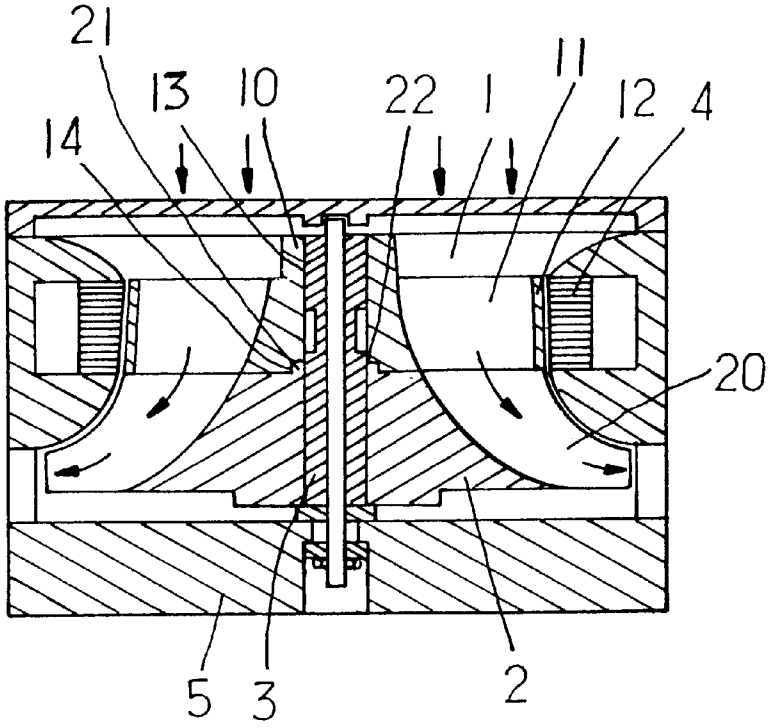
FIG. 3 is a sectional view of this invention, showing airflow path.

Referring to FIGS. 3 and 4, when in use, the motor is energized to drive the blades 11 and vanes 20 rotating. Airflow at the upper end of the fan assembly is sucked into the axial fan 1 inside the motor shell 12, and is flowing pass the curved surface of the blades 11 and is completely channeled into the centrifugal fan 2. Because of the blades 11 and vanes 20 are axially aligned and superposed with each other, airflow will be converged and spun out because of centrifugal force without dispersing whereby to increase airflow volume and heat dissipating efficiency.

What is claimed is:

1. A high performance radiator fan comprising an axial fan assembled with a centrifugal fan, wherein:

the axial fan includes a protrusive circular hub in the center thereof and a plurality of equally spaced arch-shaped blades extended outward from the hub to connect with a closed periphery shell of a motor, the hub having a recess formed at the bottom end thereof and a spindle aperture formed in the center thereof for engaging with a spindle;

the centrifugal fan includes a barrel structure in the center and a plurality of equally spaced vanes extended outward from the barrel structure to the periphery thereof, the number of the vanes being twice that of the blades, each blade being engaged and superimposed with one of the vanes axially, the barrel structure having an engaging ring at the top end thereof engageable with the recess and a spindle opening in the center thereof for engaging with the spindle; and a motor coil surrounds the shell;

wherein when the motor is energized and rotates, airflow above the axial fan will be drawn into the axial fan and passing through the blades and be completely converged into the centrifugal fan for discharging out by centrifugal force.

* * * * *